US012778330B2

(12) United States Patent
Worthing et al.

(10) Patent No.: US 12,778,330 B2
(45) Date of Patent: Nov. 3, 2026

(54) CONFIGURABLE FRAME ASSEMBLY FOR HOLDING TACO SHELLS

(71) Applicant: Worthing Group LLC, Clio, MI (US)

(72) Inventors: Thomas A. Worthing, Clio, MI (US); Brayden A. Worthing, Clio, MI (US); Jackson T. Worthing, Clio, MI (US); Andrea L. Worthing, Clio, MI (US)

(73) Assignee: Worthing Group LLC, Clio, MI (US)

( * ) Notice: Subject to any disclaimer, the term of this patent is extended or adjusted under 35 U.S.C. 154(b) by 0 days.

(21) Appl. No.: 18/934,629

(22) Filed: Nov. 1, 2024

(65) Prior Publication Data

US 2025/0134288 A1 May 1, 2025

Related U.S. Application Data

(60) Provisional application No. 63/546,856, filed on Nov. 1, 2023.

(51) Int. Cl.

| | |
|---|---|
| ***A47G 19/30*** | (2006.01) |
| ***A47G 21/00*** | (2006.01) |
| *B65D 5/50* | (2006.01) |
| *B65D 25/06* | (2006.01) |

(52) U.S. Cl.

CPC ..... *A47G 19/30* (2013.01); *A47G 21/001* (2013.01); *A47G 2019/306* (2013.01); *B65D 5/504* (2013.01); *B65D 25/06* (2013.01)

(58) Field of Classification Search

CPC ..... A47G 2019/036; A47G 21/001; A47G 19/30; B65D 5/504; B65D 5/48038; B65D 25/06

USPC ..... D7/504

See application file for complete search history.

(56) References Cited

U.S. PATENT DOCUMENTS 682,646 A * 9/1901 Scheuer ..... B65D 5/48038 217/31
1,785,416 A * 12/1930 La Bombard ..... B65D 5/48038 217/30
2,128,015 A * 8/1938 Sechrist ..... B65D 5/48038 217/34

(Continued)

OTHER PUBLICATIONS

Onerbuy 8 pcs Adjustable Grid Drawer Dividers—https://www.amazon.com/Onerbuy-Adjustable-Separator-Organizer-Container/dp/B07R71Q8C2/ref=asc_df_B07R71Q8C2/?tag=&linkCode=df0&hvadid=343252283192&hvpos=&hvnetw=g&hvrand=11574561799677079 45&hvpone=&hvptwo=&hvqmt=&hvdev=c&hvdvcmdl=&hvlocint=&hvlocphy=9016977&hvtargid=pla-746418370772&ref=&adgrpid=73031401630&th=1.

(Continued)

*Primary Examiner* — Nathan J Jenness
*Assistant Examiner* — Jennifer Castriotta
(74) *Attorney, Agent, or Firm* — RMCK Law Group PLC

(57) ABSTRACT

A frame assembly configured for assembly for holding taco shells includes a first frame member and a second frame member. The first frame member has a first arm, a second arm, a third arm and a fourth arm, the first frame member defining a first taco receiving channel between the first and second arms; a second taco receiving channel between the second and third arms; and a third taco receiving channel between the third and fourth arms. The second frame member has; a fifth taco receiving channel between the second and third arms; and a sixth taco receiving channel between the third and fourth arms. The first and second frame members are movable into a configuration such that the first and third taco receiving channels are aligned for receipt of a first taco and the fourth and sixth taco receiving channels are aligned for receipt of a second taco.

12 Claims, 13 Drawing Sheets

(56) References Cited

U.S. PATENT DOCUMENTS

| | | | | | |
|---|---|---|---|---|---|
| 3,343,742 | A | * | 9/1967 | Siegler | B65D 5/48038 229/120.36 |
| 3,780,892 | A | * | 12/1973 | Frank | B65D 5/48038 414/811 |
| 3,966,111 | A | * | 6/1976 | Grimes | B65D 5/48038 217/31 |
| 4,573,570 | A | * | 3/1986 | Cortopassi | A47G 19/30 426/396 |
| 4,653,645 | A | | 3/1987 | Thomas | |
| 4,793,548 | A | * | 12/1988 | Ross | B65D 5/48038 217/31 |
| 4,872,566 | A | | 10/1989 | Alsup | |
| D350,671 | S | | 9/1994 | Asner | |
| D779,271 | S | | 2/2017 | Simon | |
| D883,745 | S | | 5/2020 | He | |
| D900,549 | S | | 11/2020 | Chapman | |
| D966,815 | S | | 10/2022 | Spruell | |
| 2005/0023234 | A1 | | 2/2005 | Head | |
| 2007/0205171 | A1 | | 9/2007 | Iwata | |
| 2022/0400881 | A1 | | 12/2022 | Mitchell | |

OTHER PUBLICATIONS

Taco Holders 4 Pack—Stainless Steel Taco Stand Rack—https://www.amazon.com/Taco-Holder-Stand-Packs-Dishwasher/dp/B07FBNFPHG/ref=sr_1_1_sspa?crid=2KI4S2P6814BD&keywords=taco+stand&qid=1691515802&sprefix=taco+stand%2Caps%2C169&sr=8-1-spons&sp_csd=d2lkZ2VOTmFtZT1zcF9hdGY&psc=1.

Youngever 8 Pack Plastic Taco Holder Stand—https://www.amazon.com/Taco-Holder-Stand-Packs-Dishwasher/dp/B07FBNFPHG/ref=sr_1_1_sspa?crid=2KI4S2P6814BD&keywords=taco+stand&qid=1691515802&sprefix=taco+stand%2Caps%2C169&sr=8-1-spons&sp_csd=d2lkZ2VOTmFtZT1zcF9hdGY&psc=1.

* cited by examiner

CONFIGURABLE FRAME ASSEMBLY FOR HOLDING TACO SHELLS

CROSS REFERENCE TO RELATED APPLICATIONS

This application claims the benefit of priority to U.S. Provisional Patent Application No. 63/546,856 filed Nov. 1, 2023. The above application is hereby incorporated by reference in its entirety as if fully set forth herein.

FIELD

The present disclosure relates generally to a frame assembly that is assembled in a plurality of different configurations for holding food items such as taco shells.

BACKGROUND

Tacos have long been a popular food choice due to their widely regarded delicious taste and adaptability. Tacos can come in many different shapes and sizes. Similarly taco shells are offered in various varieties such as hard and soft, corn and flour. As tacos can easily accommodate a wide variety of ingredients such as beef, chicken, fish, shrimp, vegetables, rice, lettuce, cheese and others, tacos are a popular selection for families or other gatherings where one taco can be built with ingredients entirely differently than another taco. With all of the different taco sizes and configurations it can be difficult to hold one or more tacos in a presentable manner, such as on a plate. For example, some tacos, such as soft shell tacos can tend to fall apart. Moreover, some hard shell tacos can tend to fall over and spill their ingredients onto the plate. These challenges become exacerbated when a user wishes to build multiple tacos and place them onto a plate. In this regard, it would be desirable to provide a convenient system for arranging tacos in an orderly fashion on a plate.

The background description provided herein is for the purpose of generally presenting the context of the disclosure. Work of the presently-named inventors, to the extent it is described in this background section, as well as aspects of the description that may not otherwise qualify as prior art at the time of filing, are neither expressly nor impliedly admitted as prior art against the present disclosure.

SUMMARY

A frame assembly configured for assembly in at least two distinct configurations for holding taco shells includes a first frame member and a second frame member. The first frame member has a first arm, a second arm, a third arm and a fourth arm, the first frame member defining a first taco receiving channel between the first and second arms; a second taco receiving channel between the second and third arms; and a third taco receiving channel between the third and fourth arms. The second frame member has a first arm, a second arm, a third arm and a fourth arm, the first frame member defining a fourth taco receiving channel between the first and second arms; a fifth taco receiving channel between the second and third arms; and a sixth taco receiving channel between the third and fourth arms. The first frame member is movable into a first configuration wherein the first and fourth arms are coupled such that the first and third taco receiving channels are aligned for receipt of a first taco. The first and second frame members are movable into a second configuration wherein the first arm of the first frame member and the fourth arm of the second frame member are coupled, and the fourth arm of the first frame member and the first arm of the second frame member are coupled such that (i) the first and third taco receiving channels are aligned for receipt of a first taco and (ii) the fourth and sixth taco receiving channels are aligned for receipt of a second taco.

In other features, the first arm of the first frame member defines a first slot that receives a complementary slot defined on the second frame member and wherein the fourth arm of the first frame member defines a fourth slot that receives a complementary slot defined on the first frame member in the second configuration.

In examples, the first taco receiving channel is defined by a cavity wall having a notch thereon, the notch configured to locate a bottom shell of the first taco.

According to some implementations, the first taco receiving channel is defined by a cavity wall having a pair of grooves configured to locate respective top edges of the first taco.

In additional features, the grooves are formed proximate to a bottom of the first taco receiving channel.

In other examples, the grooves are formed proximate to a top of the first taco receiving channel.

According to other implementations, the frame assembly is further configured for assembly in a third distinct configuration, wherein the first and second frame members are movable into the third configuration wherein the first arm of the first frame member and the fourth arm of the second frame member are coupled, and the fourth arm of the first frame member and the first arm of the second frame member are coupled such that (i) the first and fourth taco receiving channels are aligned for receipt of a first taco; (ii) the second and fifth taco receiving channels are aligned for receipt of a second taco; and (iii) the third and sixth taco receiving channels are aligned for receipt of a third taco.

In examples, the first and second frame members are formed of pliable material.

In other examples, the first and second frame members are formed of food grade plastic.

In another example, a frame assembly configured for assembly in a configuration for holding taco shells is provided. The frame assembly includes a first, second, third and fourth frame member. The first frame member has a first arm, a second arm, a third arm and a fourth arm, wherein adjacent arms define taco receiving portions therebetween. The second frame member has a first arm, a second arm, a third arm and a fourth arm, wherein adjacent arms define taco receiving portions therebetween. The third frame member has a first arm, a second arm, a third arm and a fourth arm, wherein adjacent arms define taco receiving portions therebetween. The fourth frame member has a first arm, a second arm, a third arm and a fourth arm, wherein adjacent arms define taco receiving portions therebetween. The second and third arms of each of the first, second, third and fourth frame members define first and second slots, respectively configured to interconnect and thereby couple frames together. The first frame member is interconnected to the second and third frame members, the second frame member is interconnected to the first and fourth frame members, the third frame member is interconnected to the first and fourth frame members, and the fourth frame member is interconnected to the second and third frame members.

According to additional features, the first slot of the first frame member locates into the first slot of the third frame member.

In other examples, the second slot of the first frame member locates into the first slot of the fourth frame member.

In other implementations, the first slot of the second frame member locates into the second slot of the second frame member.

In other configurations, the second slot of the second frame member locates into the second slot of the fourth frame member.

In examples, the first and second frame members are formed of pliable material.

In other examples, the first and second frame members are formed of food grade plastic.

BRIEF DESCRIPTION OF THE DRAWINGS

The present disclosure will become more fully understood from the detailed description and the accompanying drawings, wherein.

DETAILED DESCRIPTION

As will be described herein, various frame members are provided that a user can select frame assembly groups that are configurable into different orientations for holding tacos.

While the following discussion and related Figures are directed toward tacos, it will be appreciated that the frame configurations of the instant disclosure can be used to hold other food items such as, but not limited to, burritos, enchiladas, hot dogs and other generally elongated items. As will become appreciated herein, a user can select frame members and easily configure the frame members in simple steps using interlocking features for arranging the frame assembly into a desired orientation for holding a given amount of tacos. In this regard, the frame members can be arranged to hold one, two, three, four, five, six or more tacos, burritos, enchiladas or combinations thereof. For ease of description, the following discussion is directed toward taco shells without any mention of the contents of the taco shells. In particular, the taco shells can be arranged on the frame assemblies in many configurations. The frame assemblies conveniently orient the tacos in an upright position that maintains the tacos in a presentable manner while keeping any taco contents generally within the taco shell.

Frame members constructed in accordance to various features of the present disclosure are shown throughout the drawings. Each frame member can be configured in unique strips having various end segments and inner segments. Each segment can be configured with slots that can cooperatively interconnect with complementary slots on another frame member. The frame members can be formed of pliable material such as food grade plastic that allows the frame members to be deflected and bent as needed to achieve the desired frame configurations described herein. Further, the frame members can be formed of materials suitable for a microwave and conventional oven.

Figure 1:
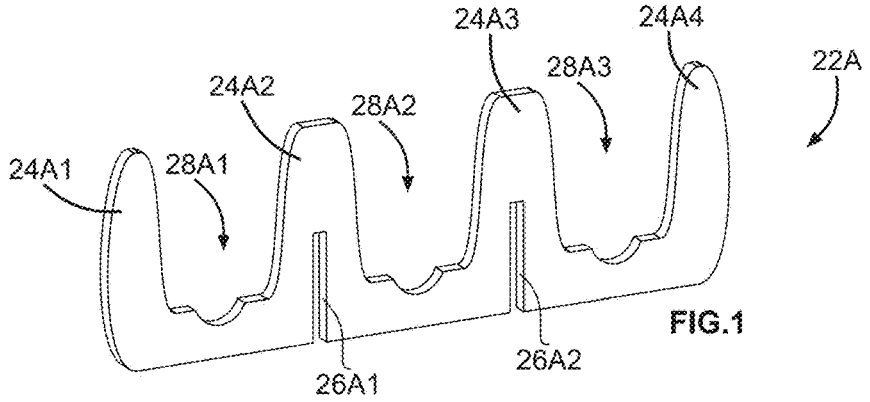
FIG. 1 is a perspective view of a first frame member constructed in accordance to a first example of the present disclosure.

With initial reference to FIG. 1, a first frame member constructed in accordance to a first example of the present disclosure is shown and generally identified at reference numeral 22A. The first frame member 22A includes arms 24A1, 24A2, 24A3 and 24A4. Slots 26A1 and 26A2 are defined in the arms 24A2 and 24A3. A first taco receiving channel 28A1 is defined between the arms 24A1 and 24A2. A second taco receiving channel 28A2 is defined between the arms 24A2 and 24A3. A third taco receiving channel 28A3 is defined between the arms 24A3 and 24A4.

Figure 2:
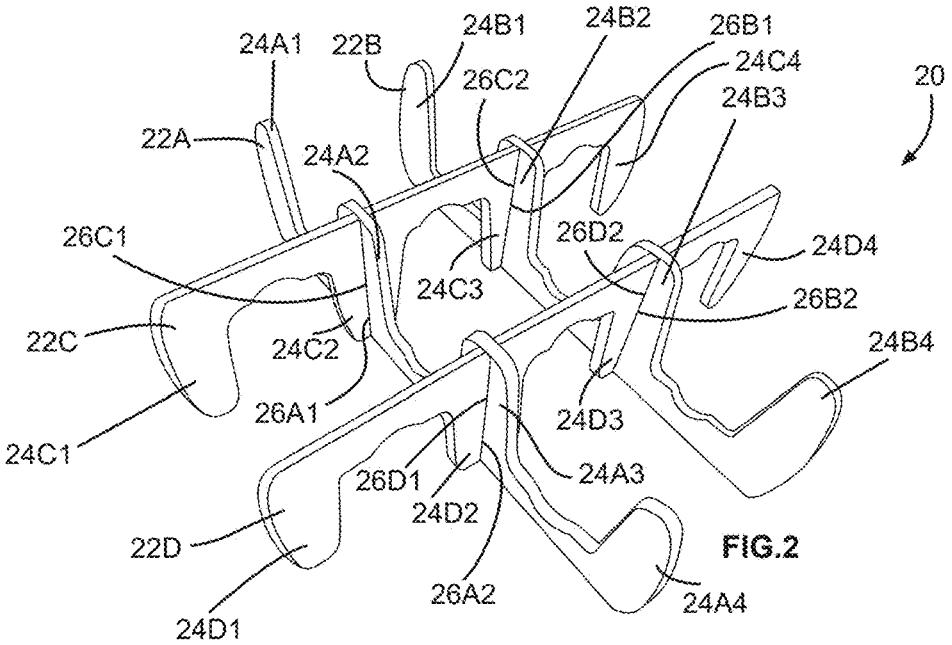
FIG. 2 is an exemplary first frame assembly group configurable in a first frame assembly orientation for holding tacos according to various examples of the present disclosure.
Figure 3:
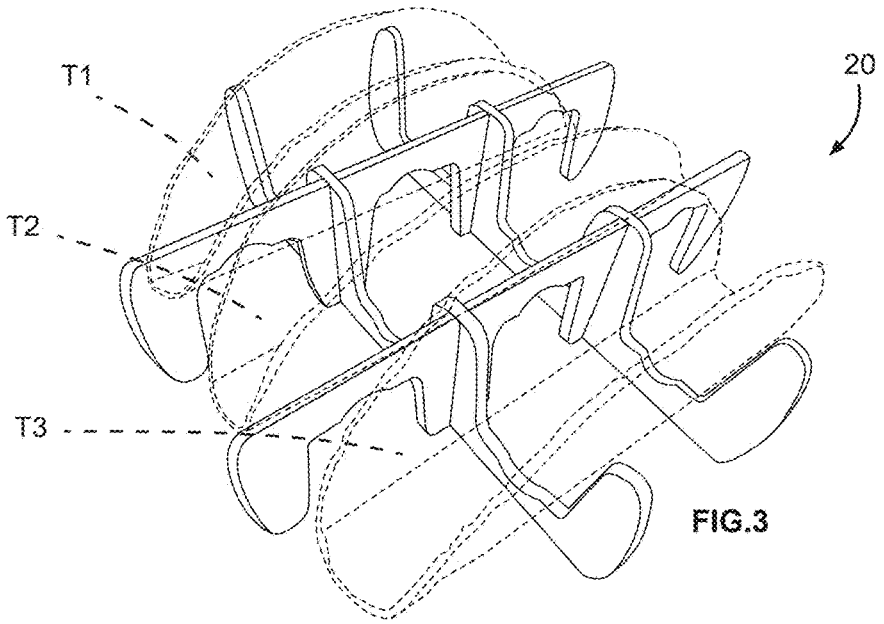
FIG. 3 is a top perspective view of the first frame assembly group of FIG. 2 and shown with example taco shells placed thereon.

Turning now to FIGS. 2-3, a first frame assembly group 20 constructed in accordance to features of the present disclosure will be described. The first frame assembly group 20 includes frame members 22A-22D. The frame members 22B-22D are constructed similarly to the frame member 22A. The frame member 22B includes arms 24B1, 24B2, 24B3 and 24B4. Slots 26B1 and 26B2 are defined in the arms 24B2 and 24B3. The frame member 22C includes arms 24C1, 24C2, 24C3 and 24C4. Slots 26C1 and 26C2 are defined in the arms 24C2 and 24C3. The frame member 22D includes arms 24D1, 24D2, 24D3 and 24D4. Slots 26D1 and 26D2 are defined in the arms 24D2 and 24D3.

Each of the frame members 22A-22D can be assembled to form the first frame assembly group 20 of FIG. 2. In particular, the frame member 22C is interconnected to the frame member 22A by slidably advancing the arm 24C2 of the frame member 22C onto the arm 24A2 of the frame member 22A while aligning the respective slots 26A1 and 26C1. Similarly, the frame member 22D is interconnected to the frame member 22A by slidably advancing the arm 24D2 of the frame member 22D onto the arm 24A3 of the frame member 22A while aligning the respective slots 26A2 and 26D2. Similarly, the frame member 22B is interconnected to the frame member 22C by slidably advancing the arm 24B2 of the frame member 22B onto the arm 24C3 of the frame member 22C while aligning the respective slots 26B1 and 26C2. Additionally, the frame member 22B is interconnected to the frame member 22D by slidably advancing the arm 24B3 of the frame member 22B onto the arm 24D3 of the frame member 22D while aligning the respective slots 26B2 and 26D2.

FIG. 3 is a top perspective view of the first frame assembly group 20 of FIG. 2 and shown with example taco shells T1, T2 and T3 placed thereon. As shown, adjacent arms of the respective frame members define taco receiving portions therebetween.

Figure 4:
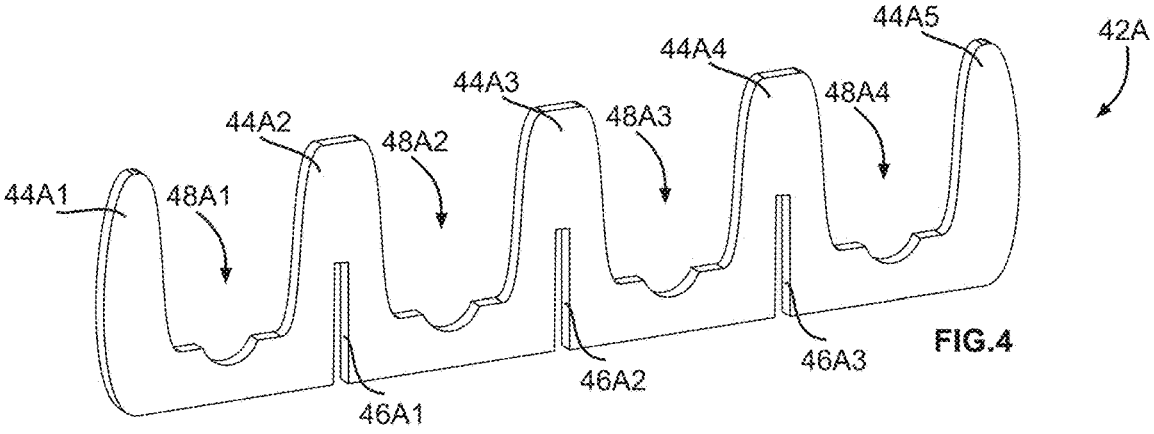
FIG. 4 is a perspective view of an exemplary second frame member constructed in accordance to a second example of the present disclosure.

With reference now to FIG. 4, a second frame member constructed in accordance to a first example of the present disclosure is shown and generally identified at reference numeral 42A. The second frame member 42A includes arms 44A1, 44A2, 44A3, 44A4 and 44A5. Slots 46A1, 46A2 and 46A3 are defined in the arms 44A2, 44A3 and 44A4, respectively. A first taco receiving channel 48A1 is defined between the arms 44A1 and 44A2. A second taco receiving channel 48A2 is defined between the arms 44A2 and 44A3. A third taco receiving channel 48A3 is defined between the arms 44A3 and 44A4. A fourth taco receiving channel 48A4 is defined between the arms 44A4 and 44A5.

Figure 5:
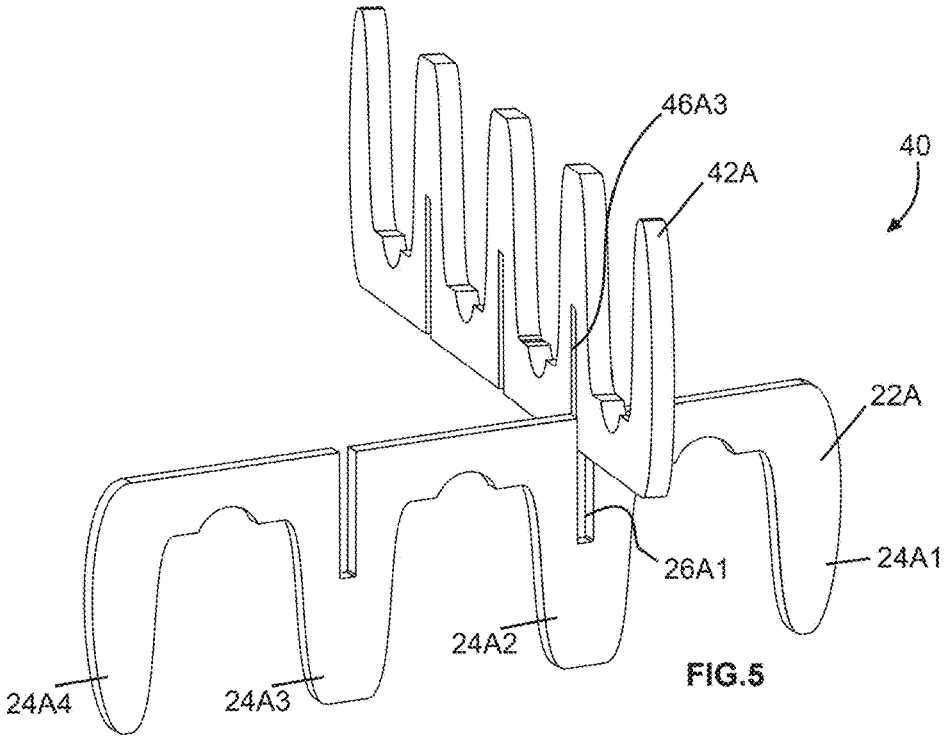
FIG. 5 is an exemplary assembly step illustrating a pair of second frame members being coupled together.
Figure 6:
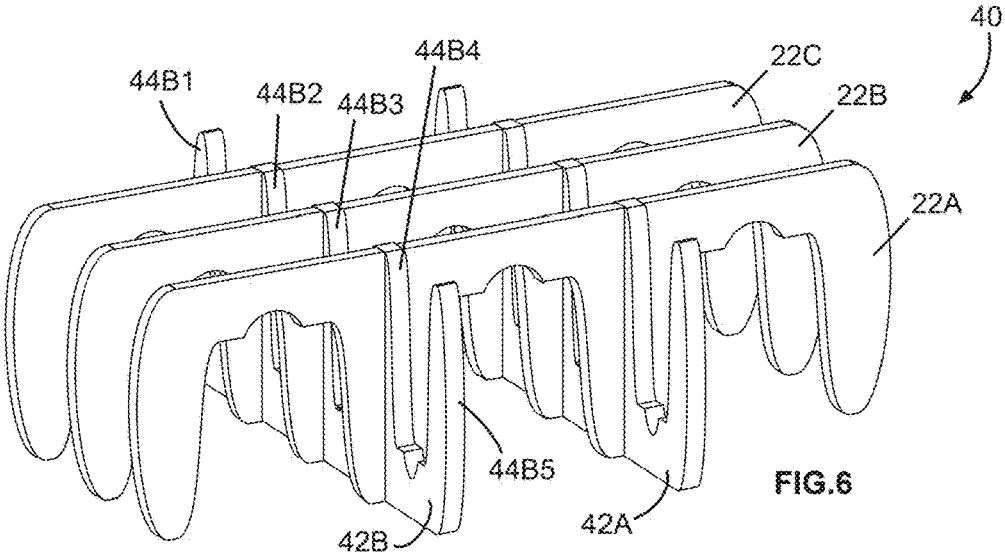
FIG. 6 is a top perspective view of a second frame assembly group constructed in accordance to additional features of the present disclosure.
Figure 7:
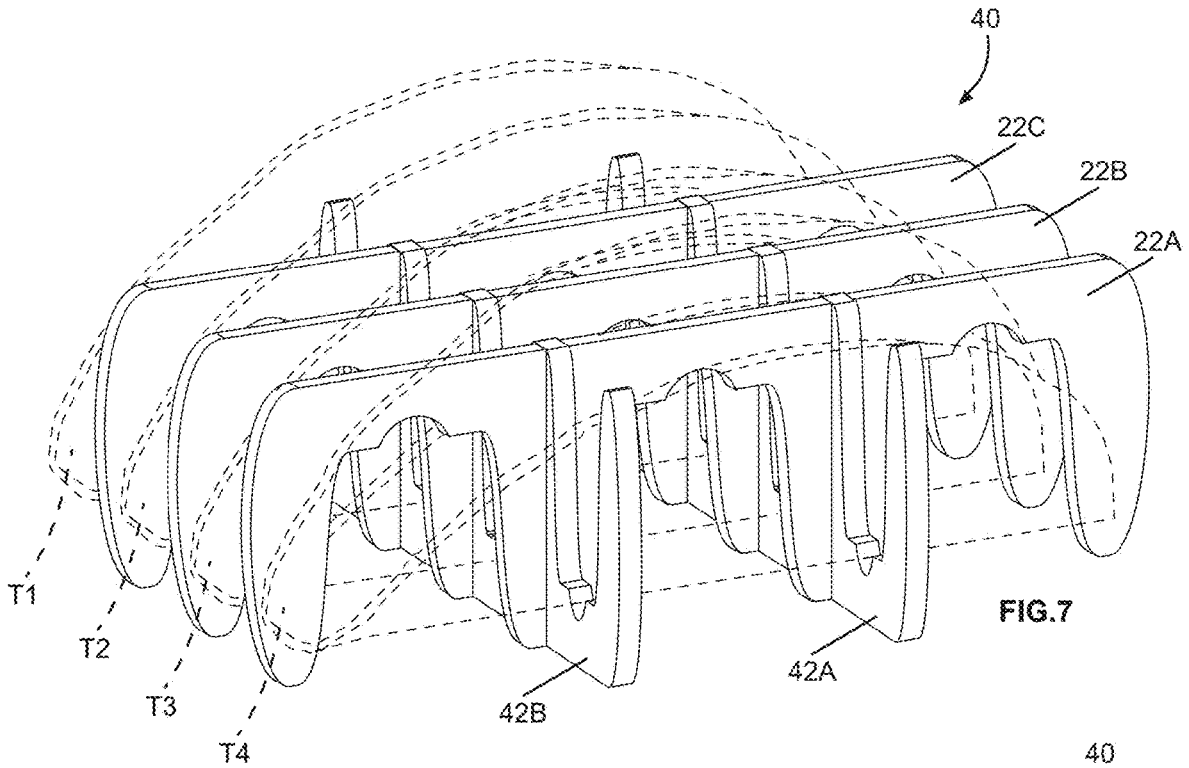
FIG. 7 is a top perspective view of the second frame assembly group of FIG. 6 and shown with example taco shells placed thereon.
Figure 8:
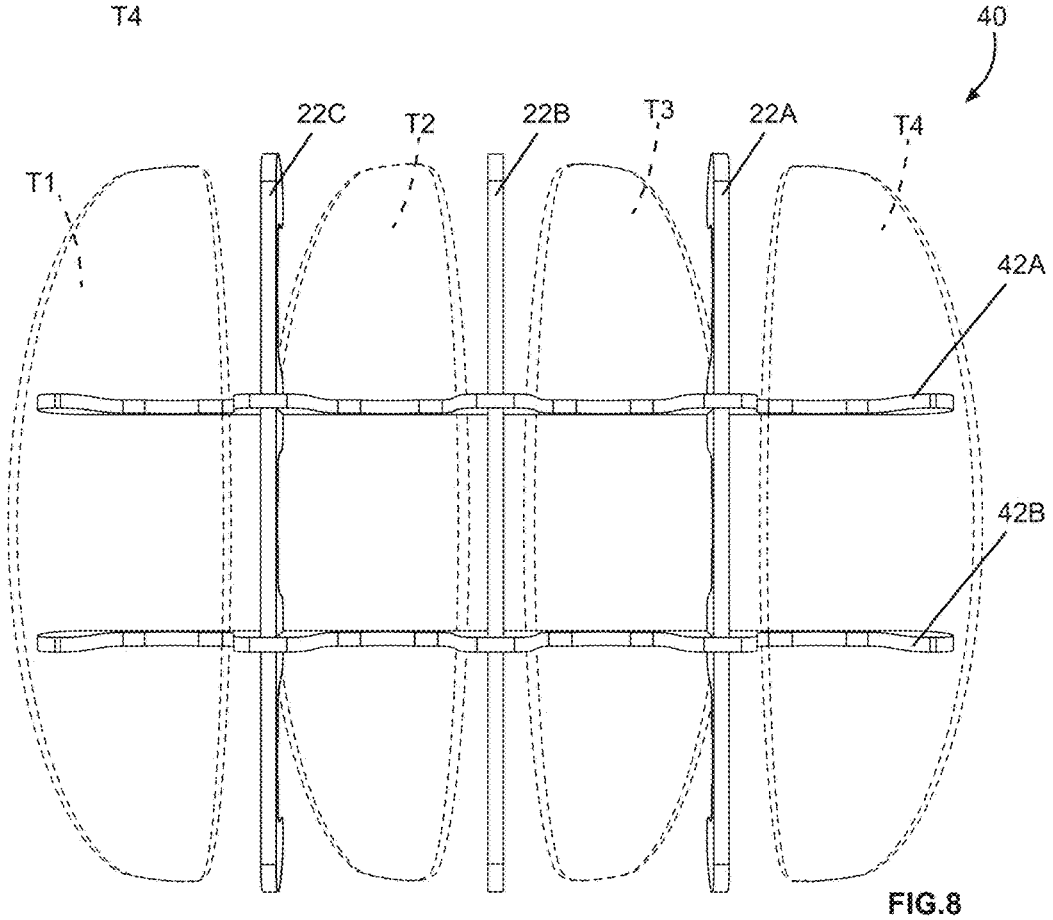
FIG. 8 is a top view view of the second frame assembly group of FIG. 6 and shown with example taco shells placed thereon.

Turning now to FIGS. 4-8, a second frame assembly group 40 constructed in accordance to features of the present disclosure will be described. The second frame assembly group 40 includes frame members 42A, 42B, 22A, 22B and 22C. The frame member 42B includes arms 44B1, 44B2, 44B3, 44B4 and 44B5. Assembly of the second frame assembly group 40 is accomplished consistent with the description above with respect to the frame assembly group 20. For example, and as shown in FIG. 5, the slots 26A1 of frame member 22A is aligned for receipt by the slot 46A3 of the frame member 42A. FIG. 7 is a top perspective view of the second frame assembly group of FIG. 6 and shown with example taco shells T1-T4 placed thereon.

Figure 9:
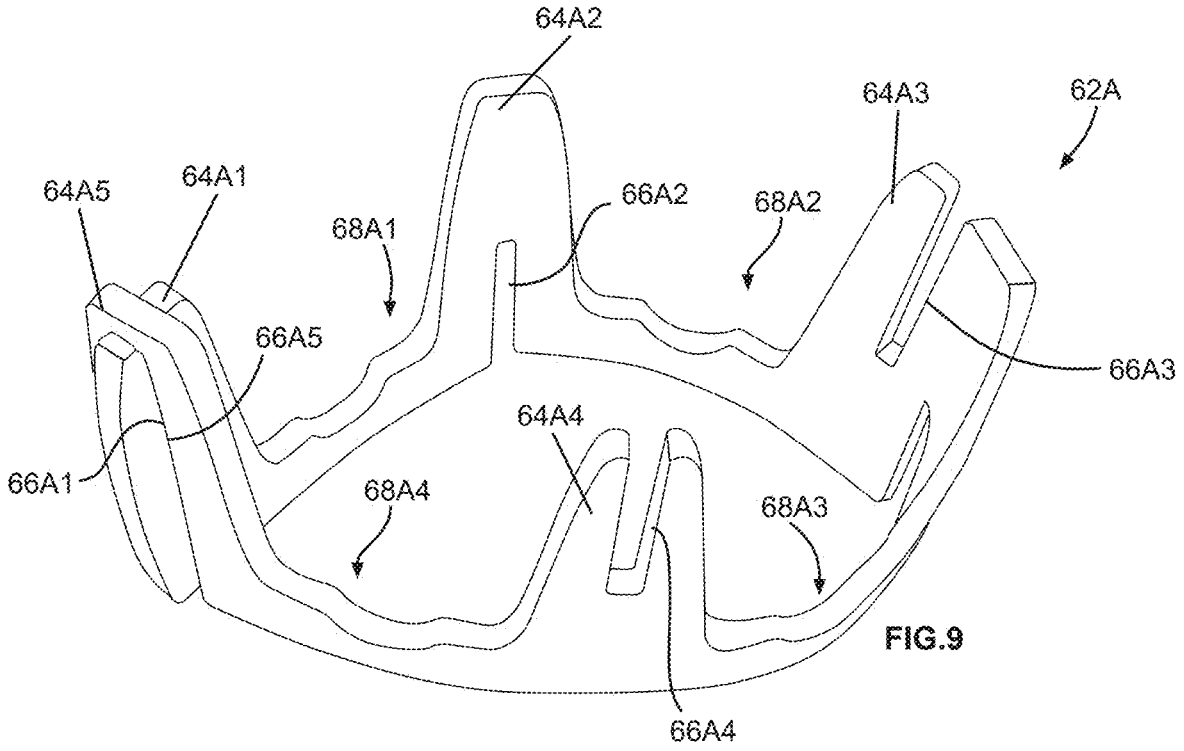
FIG. 9 is a perspective view of an exemplary third frame member constructed in accordance to a third example of the present disclosure and shown in a first taco ready assembled position.
Figure 10:
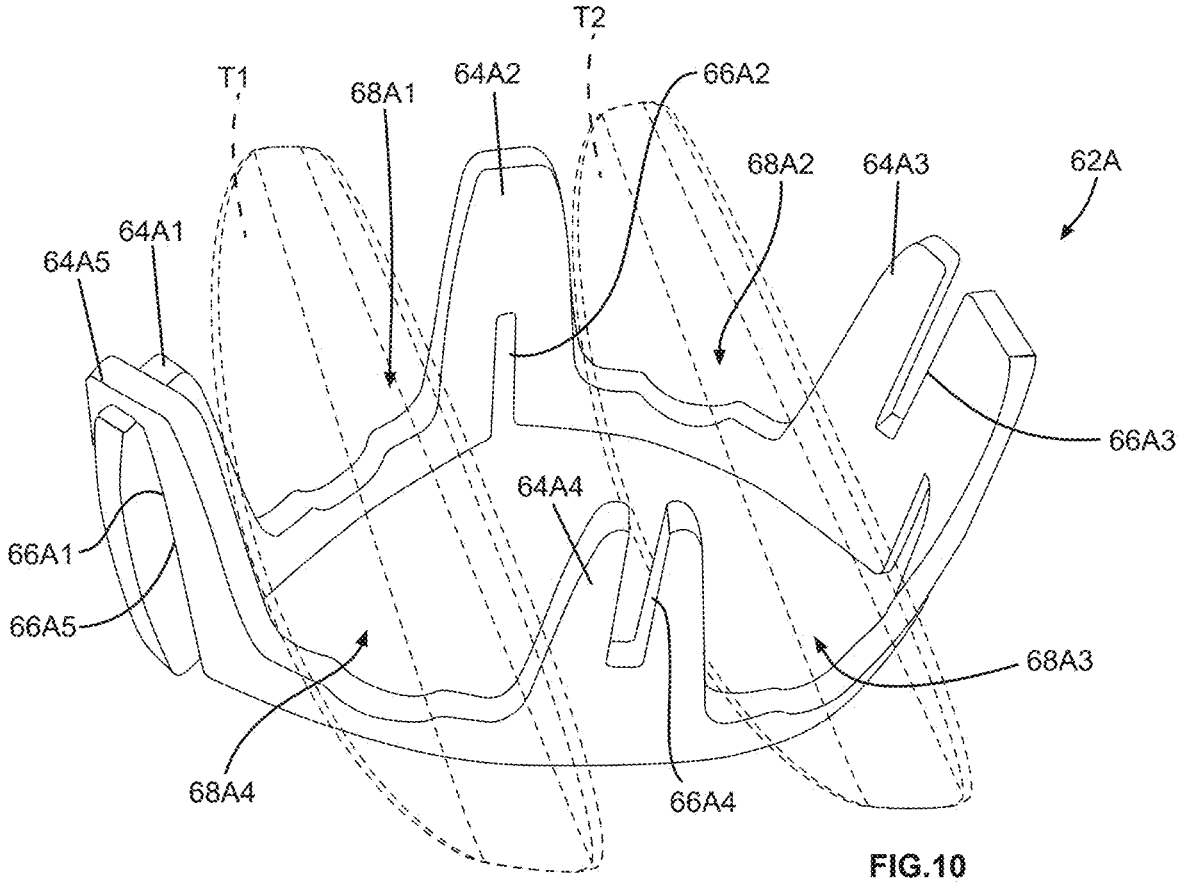
FIG. 10 is an exemplary third frame member of FIG. 9 and shown with example taco shells placed thereon.

FIG. 9 is an exemplary third frame member 62A constructed in accordance to a third example of the present disclosure and shown in a first taco ready assembled position. The third frame member 62A includes arms 64A1, 64A2, 64A3, 64A4 and 64A5. Slots 66A1, 66A2, 66A3, 66A4 and 66A5 are defined in the arms 64A1, 64A2, 64A3 and 64A5, respectively. In the first taco ready assembled position, the slot 66A1 of the arm 64A1 is received by the slot 66A5 of the arm 64A5. A first taco receiving channel 68A1 is defined between the arms 64A1 and 64A2. A second taco receiving channel 68A2 is defined between the arms 64A2 and 64A3. A third taco receiving channel 68A3 is defined between the arms 64A3 and 64A4. A fourth taco receiving channel 68A4 is defined between the arms 64A4 and 64A5. In the first taco ready assembled position, a taco T1 is received by the first and fourth taco receiving channels 68A1 and 68A4. A taco T2 is received by the second and third taco receiving channels 68A2 and 68A3.

Figure 11:
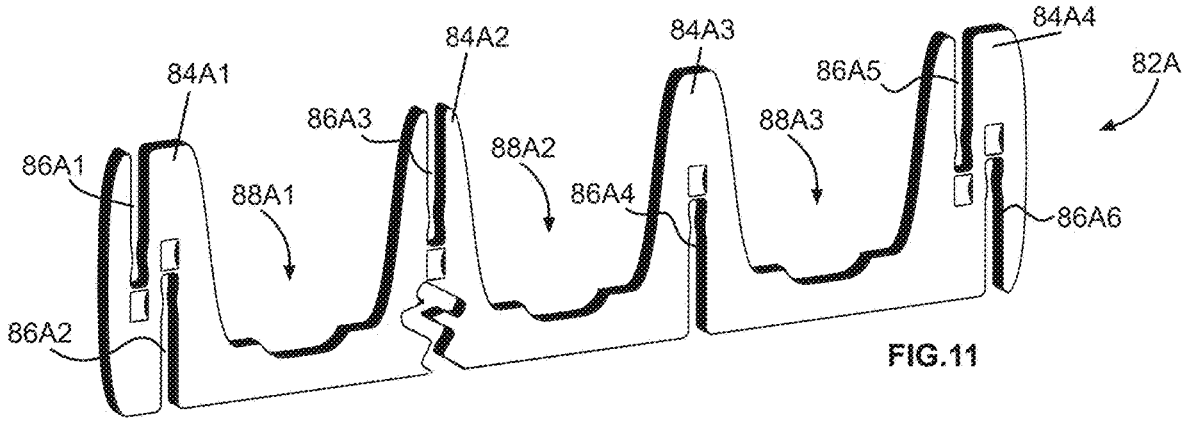
FIG. 11 is a perspective view of an exemplary fourth frame member constructed in accordance to a fourth example of the present disclosure.

With reference now to FIG. 11, a fourth frame member constructed in accordance to another example of the present disclosure is shown and generally identified at reference numeral 82A. The fourth frame member 82A includes arms 84A1, 84A2, 84A3, and 84A4. Slots 86A1 and 86A2 are formed in the arm 84A. Slot 86A3 is formed in the arm 84A2. Slot 86A4 is formed in the arm 84A3. Slots 86A5 and 86A6 are formed in the arm 84A4. A first taco receiving channel 88A1 is defined between the arms 84A1 and 84A2. A second taco receiving channel 88A2 is defined between the arms 84A2 and 84A3. A third taco receiving channel 88A3 is defined between the arms 84A3 and 84A4.

Figure 12:
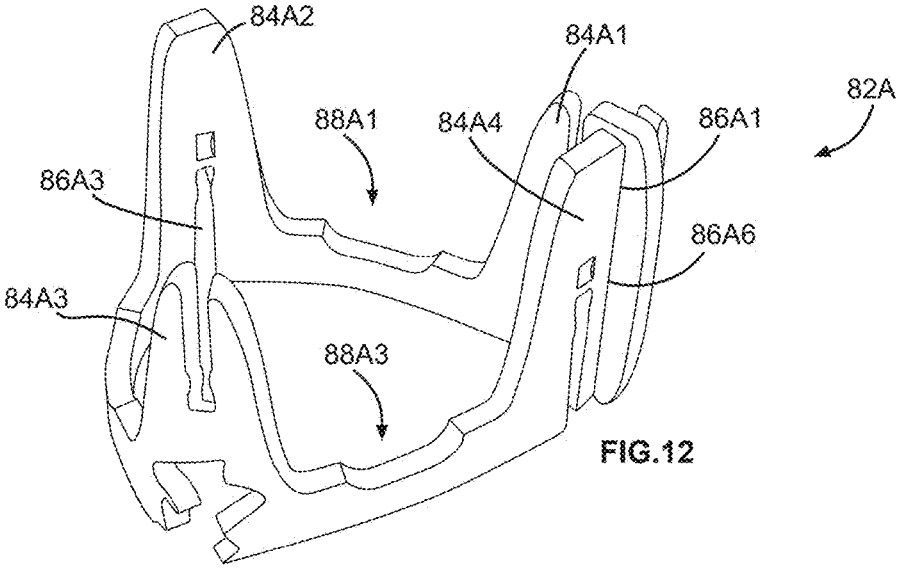
FIG. 12 is an exemplary fourth frame member of FIG. 11 and shown configured with first and fourth arms coupled together in a first taco ready assembled position.
Figure 13:
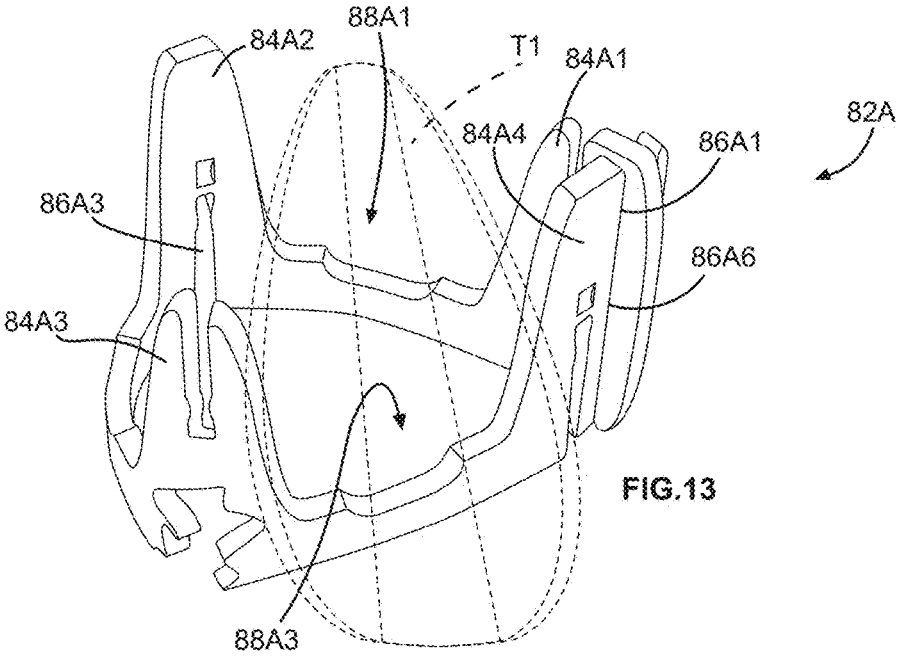
FIG. 13 is an exemplary fourth frame member of FIG. 12 and shown with example taco shells placed thereon.

FIGS. 12 and 13 illustrates the fourth frame member 82A configured in a first taco receiving orientation. In the first taco receiving orientation, the slot 86A1 on the arm 84A1 receives the slot 86A6 on the arm 84A4. In the first taco receiving orientation, the first and third taco receiving channels 88A1 and 88A3 cooperatively align for receiving a taco T1 (FIG. 13).

Figure 14:
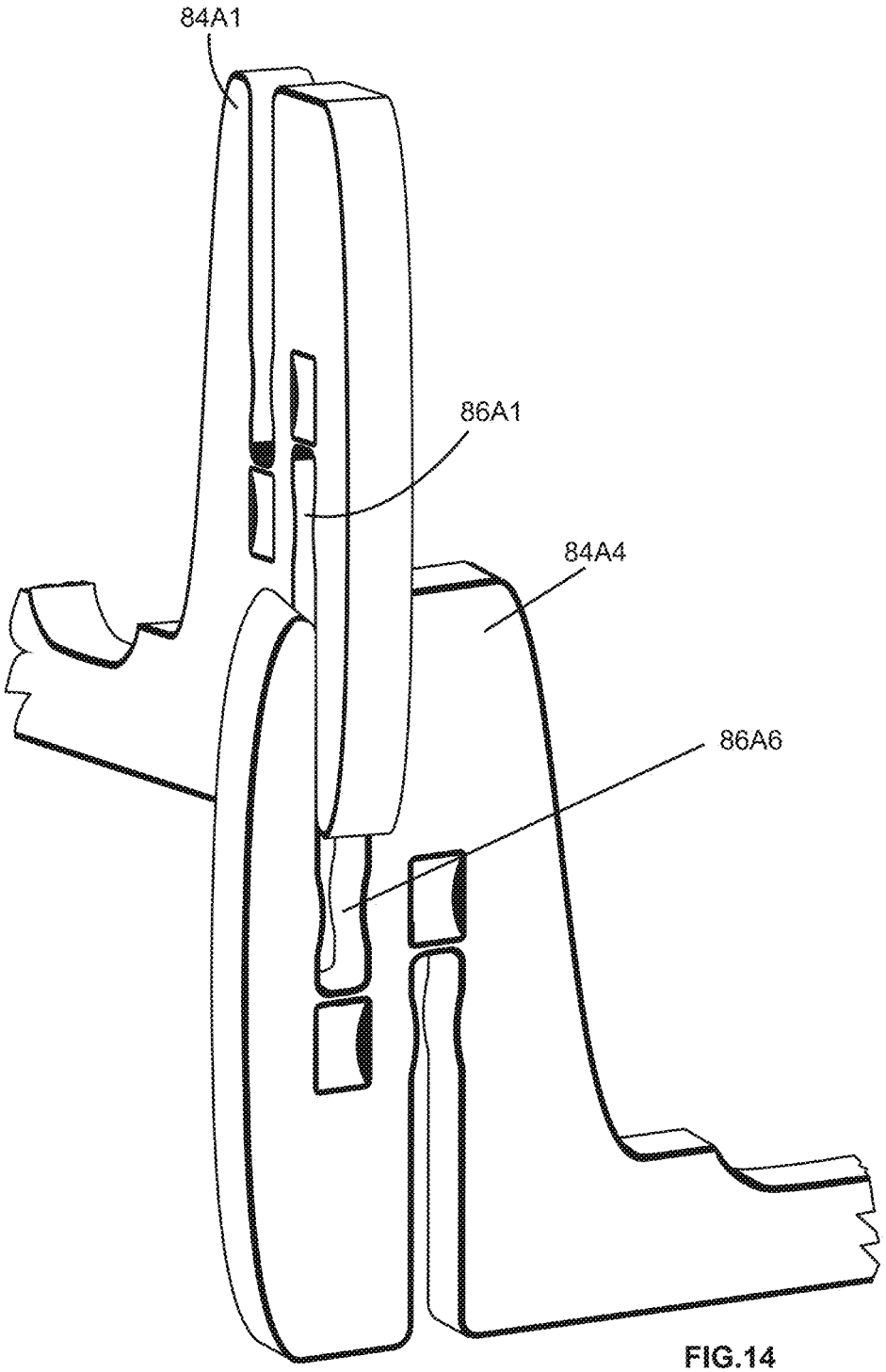
FIG. 14 is an exemplary assembly step partially illustrating a pair of fourth frame members being coupled together.

FIG. 14 is an exemplary assembly step illustrating a pair of fourth frame members 82A and 82B being coupled together showing slot 86A1 of arm 84A1 being received by slot 86A6 of arm 84A4.

Figure 15:
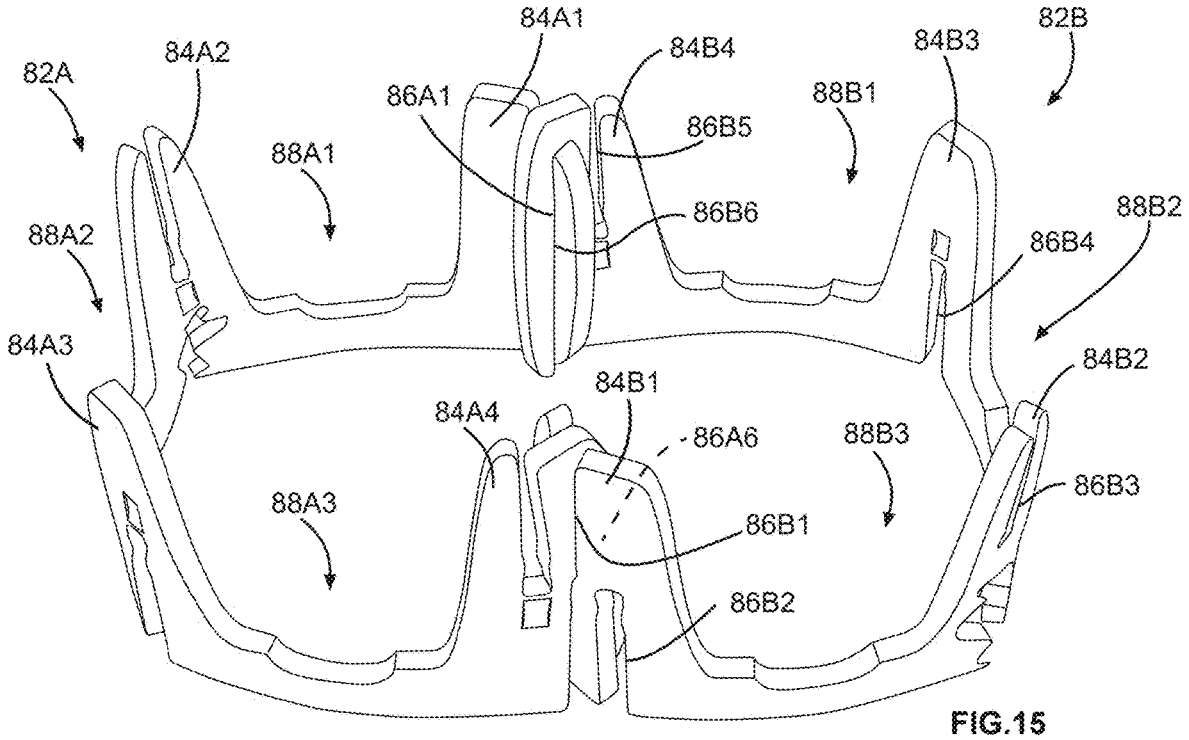
FIG. 15 is a perspective view of a pair of fourth frame members of FIG. 11 and shown assembled in a first taco ready assembled position.

With reference now to FIG. 15, another fourth frame member is shown and generally identified at reference numeral 82B. As will be described, a pair of fourth frame members 82A and 82B referred to herein as a frame assembly are coupled together in another taco receiving orientation. The fourth frame member 82B includes arms 84B1, 84B2, 84B3, and 84B4. Slots 86B1 and 86B2 are formed in the arm 84B1. Slot 86B3 is formed in the arm 84B2. Slot 86B4 is formed in the arm 84B3. Slots 86B5 and 86B6 are formed in the arm 84B4. A first taco receiving channel 88B1 is defined between the arms 84B1 and 84B2. A second taco receiving channel 88B2 is defined between the arms 84B2 and 84B3. A third taco receiving channel 88B3 is defined between the arms 84B3 and 84B4.

Figure 16:
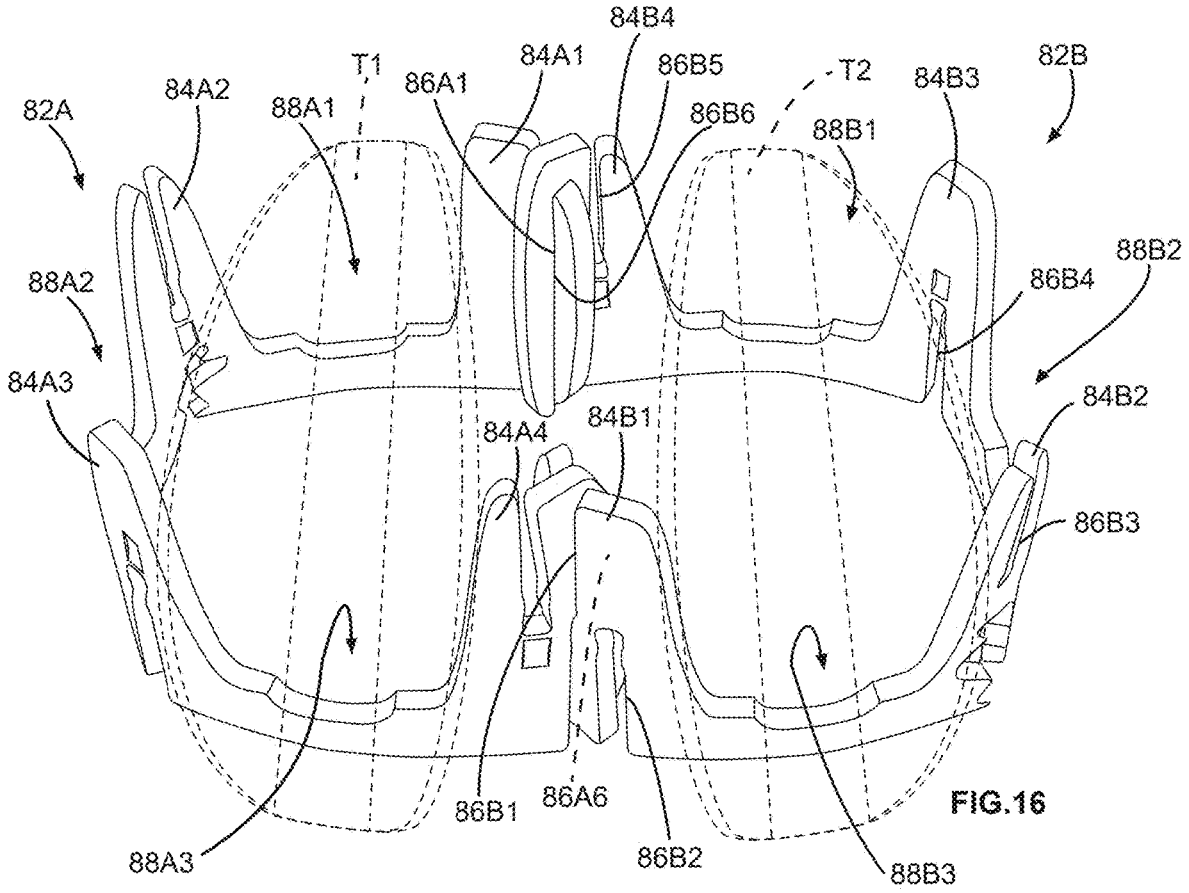
FIG. 16 is a perspective view of the pair of assembled fourth frame members of FIG. 15 and shown with example taco shells placed thereon.

In the assembled position of FIGS. 15 and 16, the slot 86A1 of the arm 84A1 is received by the slot 86B6 of the arm 84B4. Similarly, the slot 86A6 of the arm 84A4 is received by the slot 86B1 of the arm 84B1. In the assembled position, the first and third taco receiving channels 88A1 and 88A3 of the first frame 82A align to receive taco T1. Similarly, the taco receiving channels 88B1 and 88B3 of the second frame 82B align to receive taco T2.

Figure 17:
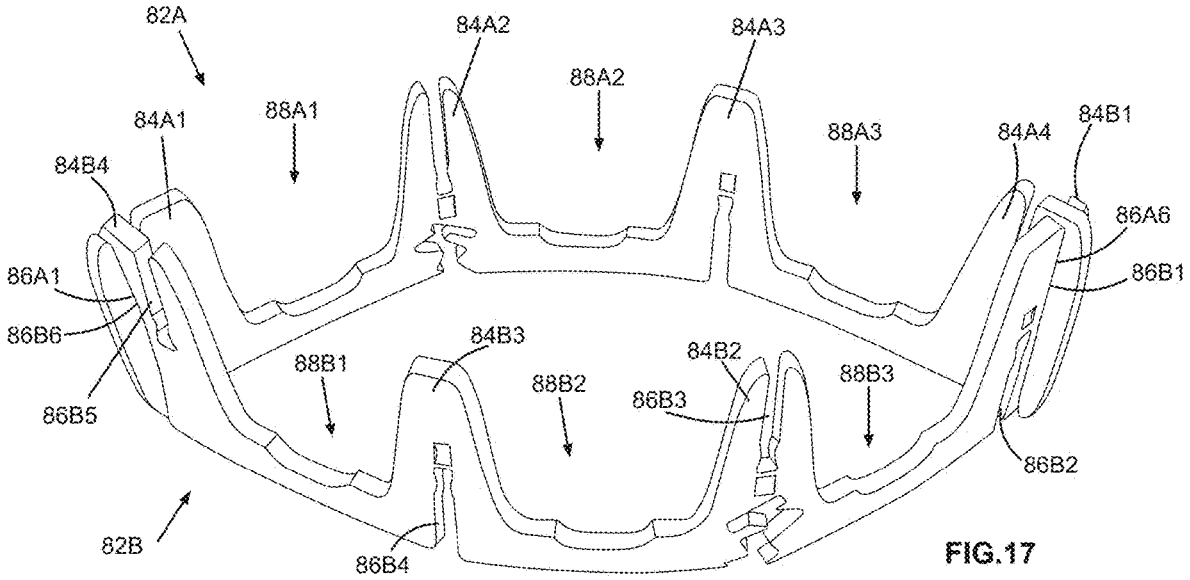
FIG. 17 is a perspective view of a pair of fourth frame members of FIG. 11 and shown assembled in a second taco ready assembled position.
Figure 18:
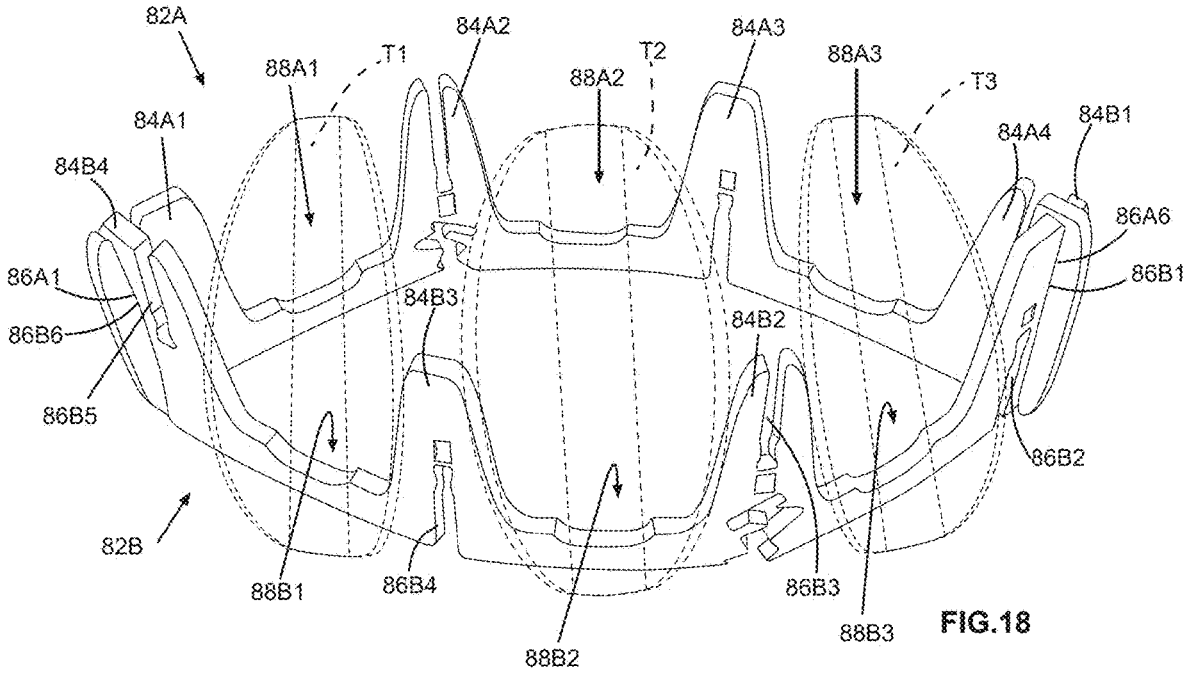
FIG. 18 is a perspective view of the pair of assembled fourth frame members of FIG. 17 and shown with example taco shells placed thereon.
Figure 19A:
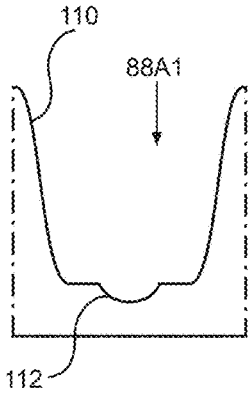
FIGS. 19A-20B show a first exemplary taco engaging channel and having a notch configured to receive tacos having distinct shapes.
Figure 19B:
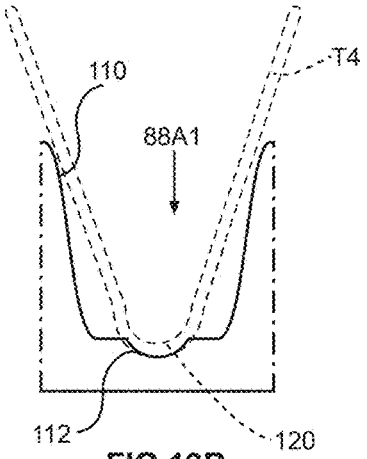

Turning now to FIGS. 17 and 18, a pair of fourth frame members 82A and 82B are assembled and coupled together in yet another taco receiving orientation. The slot 86A6 of the arm 84A4 is received by the slot 86B1 of the arm 84B1. In addition, the slot 86A1 of the arm 84A1 is received by the slot 86B6 of the arm 84B4. In the assembled position, the first respective taco receiving channels 88A1 and 88B1 align to receive taco T1. Similarly, the second respective taco receiving channels 88A2 and 88B2 align to receive taco T2. Finally, the third respective taco receiving channels 88A3 and 88B3 align to receive taco T3.

The examples shown in FIGS. 11-18 show a kit of frame members 82A and 82B that can be used in various configurations to achieve different ways of holding tacos. In particular, one frame member 82A can be used in a first orientation shown in FIG. 13 to hold one taco at the taco receiving channels 88A1 and 88A3. Two frame members 82A and 82B can be used in a second orientation shown in FIGS. 15 and 16 to hold two tacos at the taco receiving channels 88A1 and 88A3 (for receiving taco T1); and 88B1 and 88B3 (for receiving taco T2). Two frame members 82A and 82B can be used in a third orientation shown in FIGS. 17 and 18 to hold three tacos at the taco receiving channels 88A1 and 88B1 (for receiving taco T1); 88A3 and 88B3 (for receiving taco T2); and 88A3 and 88B3 (for receiving taco T3).

Figure 20A:
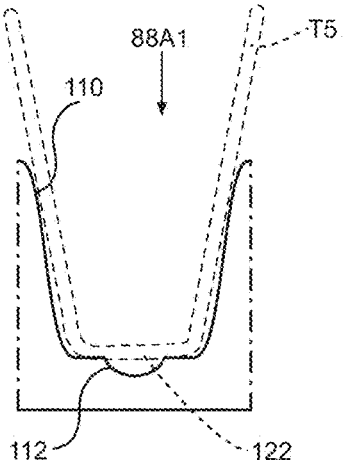
Figure 20B:
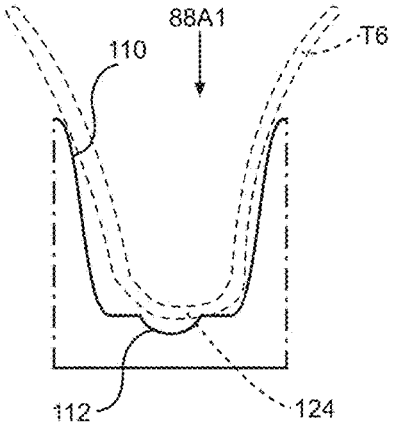

With particular reference now to FIGS. 19A-20B, the first exemplary taco engaging channel 88A1 of the frame 82A will be further described. It is appreciated that the features of the taco engaging channel 88A1 can be incorporated on any taco engaging channel described herein. The taco engaging channel 88A1 is defined by a channel wall 110. A notch 112 is further defined on the channel wall 110. The notch 112 is configured to locate a bottom shell 120 of a taco T4 (FIG. 19B). FIG. 20A shows another taco T5 having a generally square shell 122 that is received by the channel wall 110. FIG. 20B shows another taco T6 having a generally soft shell 124 that is received by the channel wall 110.

Figures 21A, 21B:
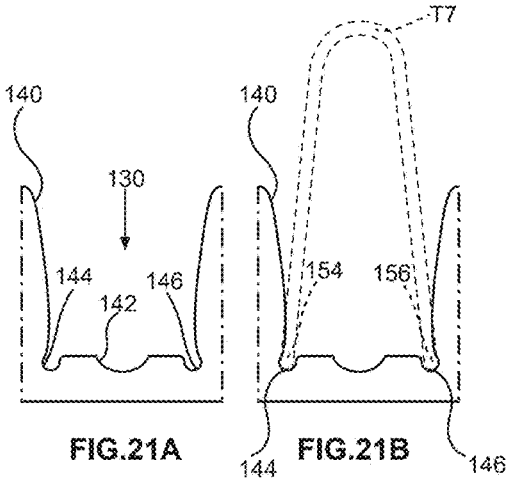
FIGS. 21A-21B show a second exemplary taco engaging channel and having grooves configured to receive ends of a taco shell for presenting the taco shell in a first inverted position.

Turning now to FIGS. 21A-21B, a taco engaging channel constructed in accordance to additional features is shown and generally identified at reference numeral 130. It is appreciated that the features of the taco engaging channel 130 can be incorporated on any taco engaging channel described herein. The taco engaging channel 130 is defined by a channel wall 140. A notch 142 is further defined on the channel wall 140. Grooves 144 and 146 are defined on the channel wall 140. The grooves 144 and 146 are configured to locate respective top edges 154, 156 of taco T7.

Figures 22A, 22B:
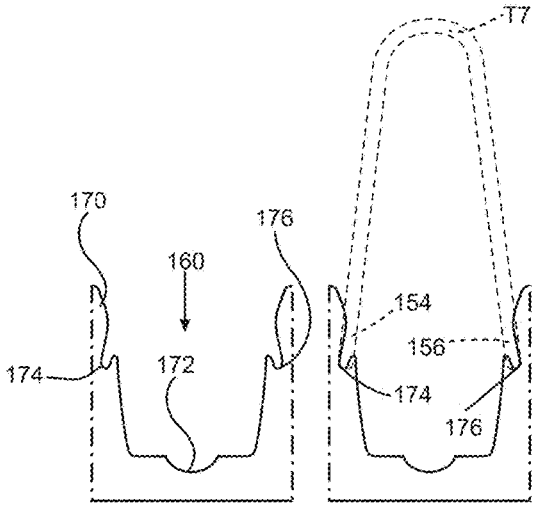
FIGS. 22A-22B show a third exemplary taco engaging channel and having grooves configured to receive ends of a taco shell for presenting the taco shell in a second inverted position.

Turning now to FIGS. 22A-22B, a taco engaging channel constructed in accordance to additional features is shown and generally identified at reference numeral 160. It is appreciated that the features of the taco engaging channel 160 can be incorporated on any taco engaging channel described herein. The taco engaging channel 160 is defined by a channel wall 170. A notch 172 is further defined on the channel wall 170. Grooves 174 and 176 are defined on the channel wall 170. The grooves 174 and 176 are configured to locate respective top edges 154, 156 of taco T7. In examples, the grooves 174 and 176 of the taco engaging channel 160 can orient the taco T7 in an elevated position on the channel wall 170.

Figures 23A, 23B:
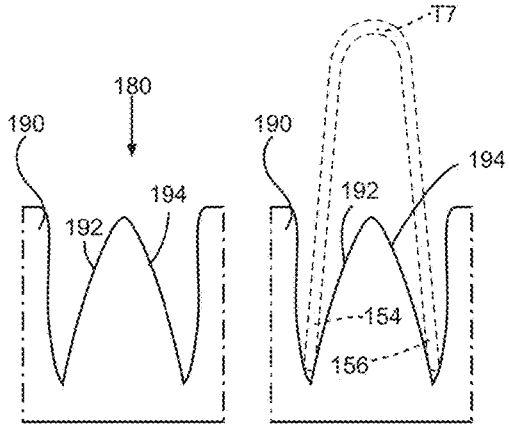
FIGS. 23A-23B show a fourth exemplary taco engaging channel and having grooves configured to receive ends of a taco shell for presenting the taco shell in a third inverted position.

Turning now to FIGS. 23A-23B, a taco engaging channel constructed in accordance to additional features is shown and generally identified at reference numeral 180. It is appreciated that the features of the taco engaging channel 180 can be incorporated on any taco engaging channel described herein. The taco engaging channel 180 is defined by a channel wall 190. The channel wall 190 includes two grooves 192 and 194 configured to locate respective top edges 154, 156 of taco T7.

Figure 24:
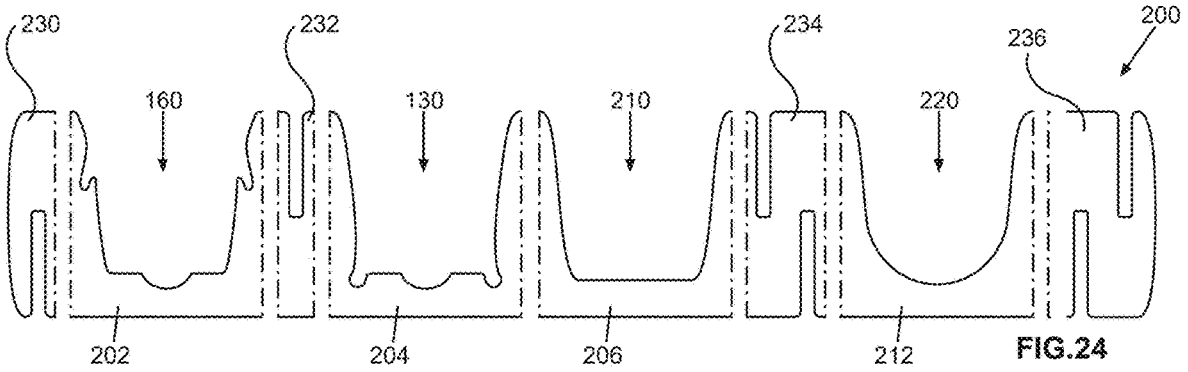
FIG. 24 is a side view of an exemplary fifth frame member constructed in accordance to a fifth example of the present disclosure, FIG. 24 representing various intermediate sections configurable as desired for a given application.
Figure 25:
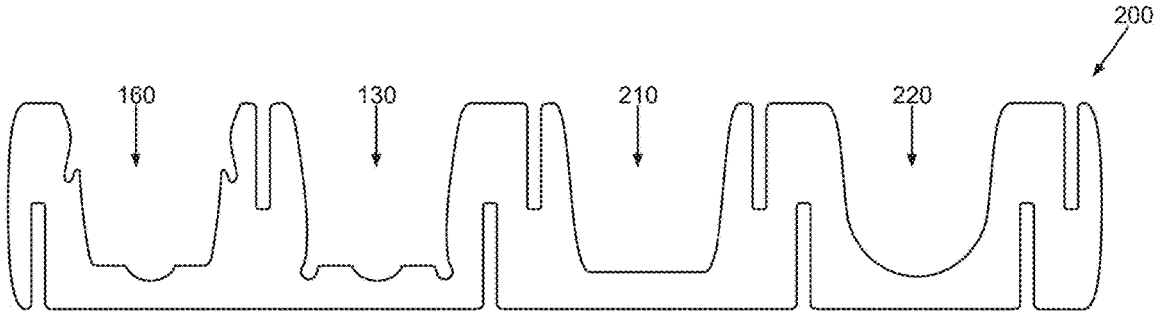
FIG. 25 is a side view of an exemplary fifth frame member, with each of the exemplary intermediate sections selected from FIG. 24.
Figure 26:
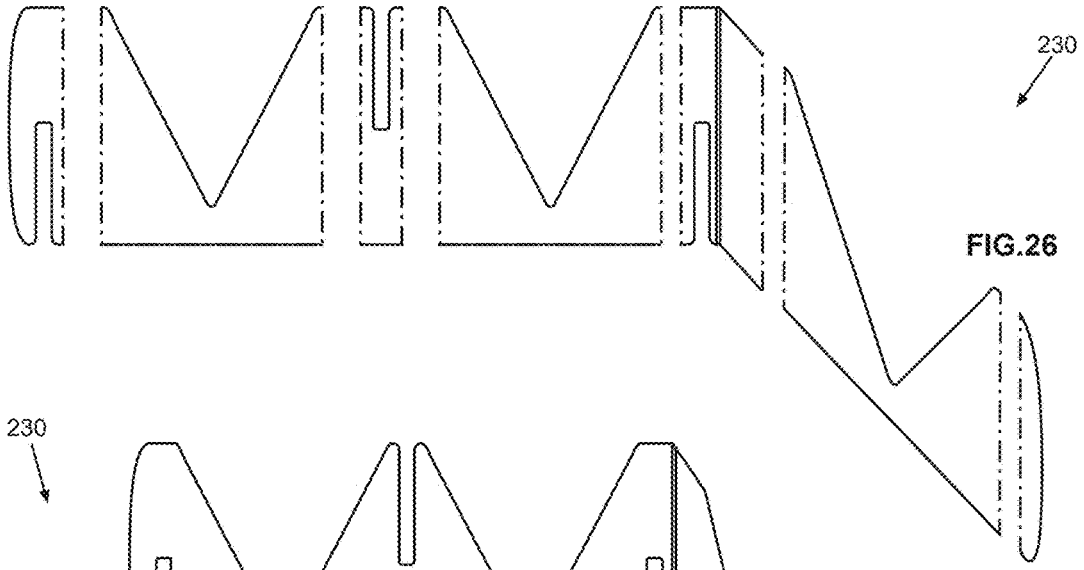
FIG. 26 is a side view of an exemplary sixth frame member constructed in accordance to a sixth example of the present disclosure, FIG. 26 representing various intermediate sections configurable as desired for a given application.
Figure 27:
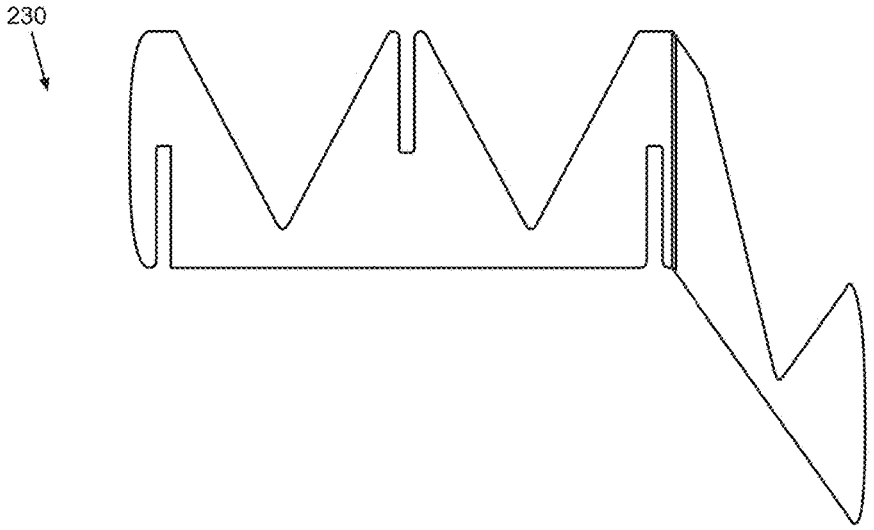
FIG. 27 is a side view of an exemplary sixth frame member, with each of the exemplary intermediate sections selected from FIG. 27.
Figure 28:
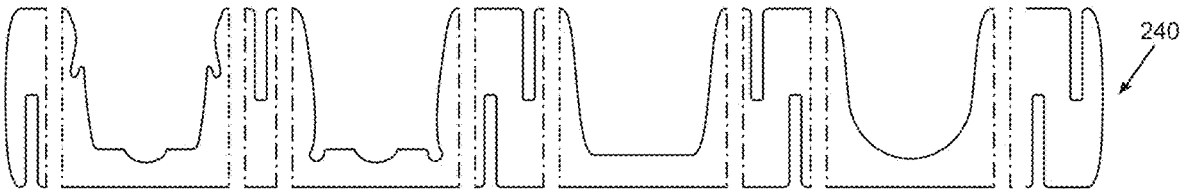
FIG. 28 is a side view of an exemplary seventh frame member constructed in accordance to a seventh example of the present disclosure, FIG. 28 representing various intermediate sections configurable as desired for a given application.
Figure 29:
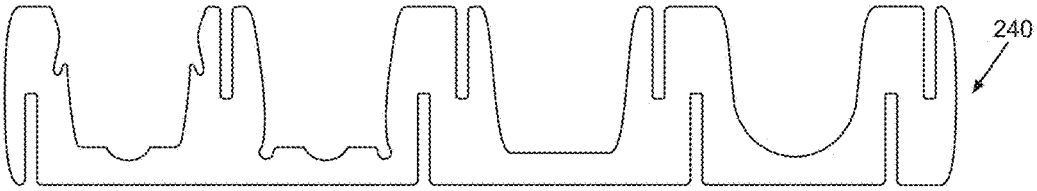
FIG. 29 is a side view of an exemplary seventh frame member, with each of the exemplary intermediate sections selected from FIG. 28.
Figure 30:
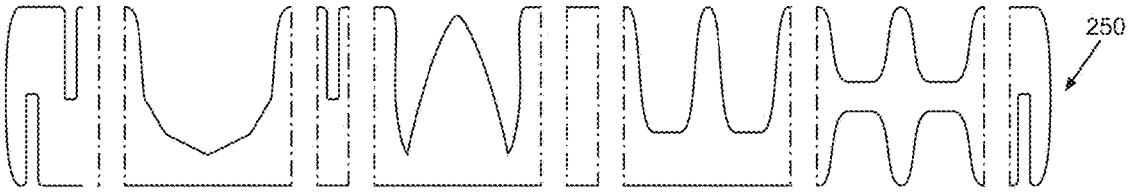
FIG. 30 is a side view of an exemplary eighth frame member constructed in accordance to an eighth example of the present disclosure, FIG. 30 representing various intermediate sections configurable as desired for a given application.
Figure 31:
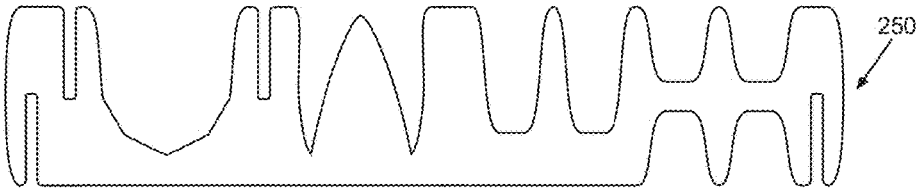
FIG. 31 is a side view of an exemplary eighth frame member, with each of the exemplary intermediate sections selected from FIG. 30.
Figure 32:
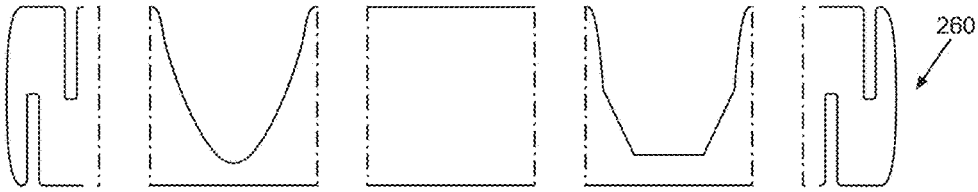
FIG. 32 is a side view of an exemplary ninth frame member constructed in accordance to a ninth example of the present disclosure, FIG. 32 representing various intermediate sections configurable as desired for a given application.
Figure 33:
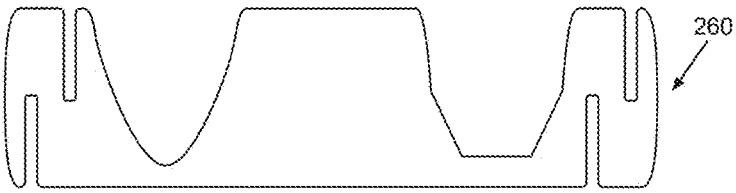
FIG. 33 is a side view of an exemplary ninth frame member, with each of the exemplary intermediate sections selected from FIG. 32.

FIG. 24 is a side view of an exemplary fifth frame member 200 constructed in accordance to a fifth example of the present disclosure. FIG. 24 represents various intermediate taco receiving sections configurable as desired for a given application. In particular, taco receiving section 202 includes the taco engaging channel 160. Taco receiving section 204 includes the taco engaging channel 130. Taco receiving section 206 includes a taco engaging channel 210. The taco engaging channel 210 has a generally square profile. Taco receiving section 212 includes a taco engaging channel 220. The taco engaging channel 220 has a generally arcuate profile. Slot sections 230, 232, 234 and 236 are shown having various slot profiles as described herein. The purpose of FIG. 24 is to illustrate that any combinations and orientations of taco engaging cavities and slot sections can be selected and incorporated into a given frame member as desired. FIGS. 25-33 illustrate various frame members 230, 240, 250, and 260 having various combinations of taco engaging cavities and slot sections.

Figure 34:
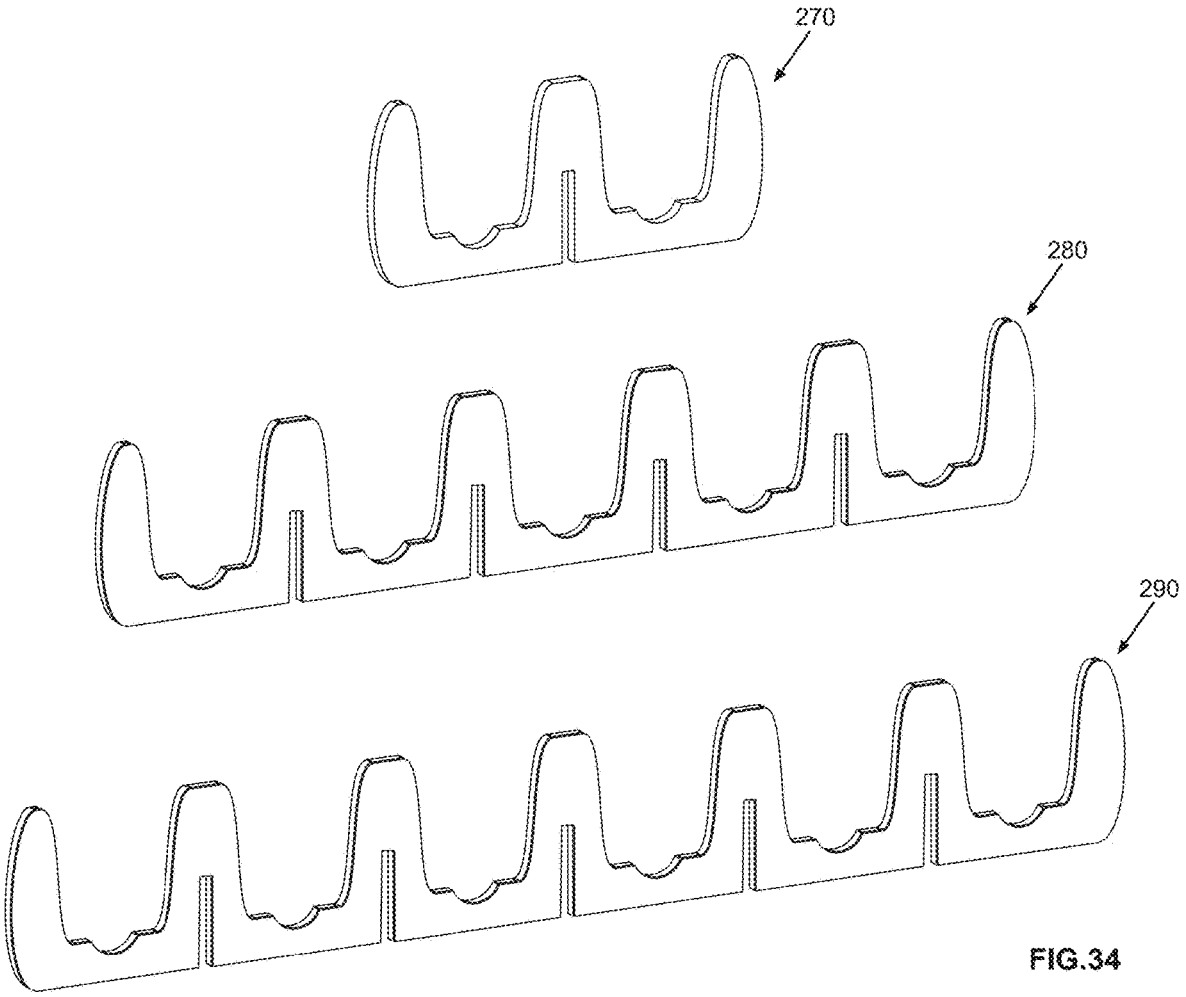
FIG. 34 is a front perspective view of exemplary tenth, eleventh and twelfth frame members constructed in accordance to additional features of the present disclosure.

FIG. 34 illustrates additional example frame members 270, 280 and 290 constructed in accordance to additional features of the present disclosure. The frame members 270, 280 and 290 have two taco engaging cavities, five taco engaging cavities and six taco engaging cavities, respectively. The taco engaging cavities are shown in accordance to the features at FIGS. 19A-20B, however any combinations of the taco engaging cavities described herein can be incorporated.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A frame assembly configured for assembly in at least two distinct configurations for holding taco shells, the frame assembly comprising:

a first frame member having a first arm having first and second slots, a second arm having a third slot, a third arm having a fourth slot and a fourth arm having fifth and sixth slots, the first frame member defining a first taco receiving channel between the first and second arms; a second taco receiving channel between the second and third arms; and a third taco receiving channel between the third and fourth arms;

a second frame member having a first arm having seventh and eighth slots, a second arm having a ninth slot, a third arm having a tenth slot and a fourth arm having eleventh and twelfth slots, the second frame member defining a fourth taco receiving channel between the first and second arms; a fifth taco receiving channel between the second and third arms; and a sixth taco receiving channel between the third and fourth arms;

wherein the first frame member is movable into a first configuration wherein the first and sixth slots of the first and fourth arms are coupled such that the first and third taco receiving channels are aligned for receipt of a first taco, wherein the first, third and fifth slots are upwardly facing and the second, fourth and sixth slots are downwardly facing;

wherein the first and second frame members are movable into a second configuration wherein the first slot of the first arm of the first frame member and the twelfth slot of the fourth arm of the second frame member are coupled, and the sixth slot of the fourth arm of the first frame member and the seventh slot of the first arm of the second frame member are coupled such that (i) the first and third taco receiving channels are aligned for receipt of a first taco and (ii) the fourth and sixth taco receiving channels are aligned for receipt of a second taco, wherein the seventh, ninth and eleventh slots are upwardly facing and the eighth, tenth and twelfth slots are downwardly facing.

2. The frame assembly of claim 1 wherein the first taco receiving channel is defined by a channel wall having a notch thereon, the notch configured to locate a bottom shell of the first taco.

3. The frame assembly of claim 2 wherein a width of the first taco receiving channel at the channel wall is progressively larger toward an opening of the first taco receiving channel.

4. The frame assembly of claim 3 wherein the channel wall has a first taco receiving surface at the notch that receives a first taco having a first shell configuration and a second taco receiving surface adjacent to the notch that receives a second taco having a second shell configuration, the first and second taco shell configurations being distinct, wherein the first taco receiving surface is distinct and deeper into the first taco receiving channel as compared to the second taco receiving surface.

5. The frame assembly of claim 1 wherein the first taco receiving channel is defined by a cavity wall having a pair of grooves configured to locate respective top edges of the first taco.

6. The frame assembly of claim 5 wherein the grooves are formed proximate to a bottom of the first taco receiving channel.

7. The frame assembly of claim 5 wherein the grooves are formed proximate to a top of the first taco receiving channel.

8. The frame assembly of claim 1 wherein the frame assembly is further configured for assembly in a third distinct configuration, wherein the first and second frame members are movable into the third configuration wherein the first slot of the first arm of the first frame member and the twelfth slot of the fourth arm of the second frame member are coupled, and the sixth slot of the fourth arm of the first frame member and the seventh slot of the first arm of the second frame member are coupled such that (i) the first and fourth taco receiving channels are aligned for receipt of a first taco; (ii) the second and fifth taco receiving channels are aligned for receipt of a second taco; and (iii) the third and sixth taco receiving channels are aligned for receipt of a third taco.

9. The frame assembly of claim 1 wherein the first and second frame members are formed of pliable material.

10. The frame assembly of claim 9 wherein the first and second frame members are formed of food grade plastic.

11. The frame assembly of claim 1 wherein first, second and third taco receiving channels each taper outwardly toward respective openings of the first, second and third taco receiving channels.

12. The frame assembly of claim 1 wherein a width of the first, second and third taco receiving channels is greater toward respective openings of the first, second and third taco receiving channels.

* * * * *